US007668482B2

(12) United States Patent
Ushikubo

(10) Patent No.: US 7,668,482 B2
(45) Date of Patent: Feb. 23, 2010

(54) STICKING SUBSTANCE REMOVING APPARATUS AND IMAGE FORMING APPARATUS

(75) Inventor: Junichi Ushikubo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/625,356

(22) Filed: Jan. 22, 2007

(65) Prior Publication Data

US 2007/0189800 A1 Aug. 16, 2007

(30) Foreign Application Priority Data

Feb. 10, 2006 (JP) ..... 2006-034199

(51) Int. Cl.
*G03G 15/02* (2006.01)

(52) U.S. Cl. ..... 399/123; 399/326; 399/327; 399/343

(58) Field of Classification Search ..... 399/99, 399/100, 123, 343, 350, 357, 326, 352, 175, 399/176, 101, 273, 283, 327, 351
See application file for complete search history.

(56) References Cited

U.S. PATENT DOCUMENTS 3,324,291 A * 6/1967 Hudson ..... 250/325
3,973,843 A * 8/1976 Lindblad et al. ..... 399/343
4,026,648 A * 5/1977 Takahashi ..... 399/101
4,457,615 A * 7/1984 Seanor ..... 399/148
4,650,311 A * 3/1987 Mayer ..... 399/129
4,947,211 A * 8/1990 Ono et al. ..... 399/105
5,023,464 A * 6/1991 Mitsuya et al. ..... 399/323
5,212,527 A * 5/1993 Fromm et al. ..... 399/326
5,214,482 A * 5/1993 Katoh ..... 399/350
5,287,150 A * 2/1994 Kinoshita et al. ..... 399/281
5,570,164 A * 10/1996 Yamamoto et al. ..... 399/283
5,799,229 A * 8/1998 Yokoyama et al. ..... 399/100
5,946,529 A * 8/1999 Sato et al. ..... 399/100
5,978,635 A * 11/1999 Azuma et al. ..... 399/283
6,144,834 A * 11/2000 Thayer ..... 399/352
6,169,867 B1 * 1/2001 Kurihara ..... 399/123
6,412,134 B1 * 7/2002 Oikawa ..... 15/102
7,209,700 B2 * 4/2007 Kubo et al. ..... 399/350
7,356,278 B2 * 4/2008 Piotrowski et al. ..... 399/100
2003/0021612 A1 * 1/2003 Morikawa et al. ..... 399/159
2005/0063728 A1 * 3/2005 Harada et al. ..... 399/100

(Continued)

FOREIGN PATENT DOCUMENTS

JP 03-101768 A 4/1991

*Primary Examiner*—David M Gray
*Assistant Examiner*—G. M. Hyder
(74) *Attorney, Agent, or Firm*—Panitch Schwarze Belisario & Nadel LLP

(57) ABSTRACT

An image forming apparatus that is capable of solving the problem of abrasion or load caused by an unevenly installed cleaning member and capable of realizing excellent cleaning performance. A cleaning section in the image forming apparatus has a cleaning member in the shape of a board, which contacts the surface of the charging roller through it's a first surface, and a fixing member, which supports the cleaning member at least at an upstream side of a contact position between the charging roller and the cleaning member with respect to the rotation direction of the charging roller. The fixing member is formed so as to not contact the cleaning member in an area of a second surface which is opposite to the contact part of the charging roller and the cleaning member.

10 Claims, 11 Drawing Sheets

U.S. PATENT DOCUMENTS

2005/0207798 A1* 9/2005 Okabe ..... 399/299
2006/0024100 A1* 2/2006 Ohta et al. ..... 399/350
2006/0088351 A1* 4/2006 Thompson et al. ..... 399/350

* cited by examiner

STICKING SUBSTANCE REMOVING APPARATUS AND IMAGE FORMING APPARATUS

BACKGROUND OF THE INVENTION

The present invention relates to a sticking substance removing apparatus to remove a sticking substance sticking on a surface of an appointed rotating body and to an image forming apparatus comprising the sticking substance removing apparatus.

Generally, an image forming apparatus of an electrophotographic type which heatedly fixes a toner image on a prescribed record medium and forms an image is well known. In operation, such an image forming apparatus, for example, irradiates light modulated according to image data corresponding to respective colors, such as cyan, magenta, yellow, black or the like, onto a charged image carrying body in order to form an electrostatic latent image. The apparatus then develops the electrostatic latent image formed on the image carrying body through developers of respective colors. Then, the image forming apparatus, through sequentially transferring the developed developer images of respective colors onto the record medium, repeatedly adapts the developer images of respective colors and forms an color image.

Such image forming apparatus comprises a developer removing apparatus to remove developer adhering to the surface of a charging roller formed by a rotating body, which contacts the image carrying body to charge the image carrying body. The developer removing apparatus, for example, is provided as a part of a charging apparatus including the charging roller, and has a cleaning member furnished along a longitudinal direction of the surface of the charging roller. Then, the cleaning member is furnished between a wall surface on an opposite side of the charging roller, and the surface of the charging roller is compressed (for example, see: patent document JP-A-H03-101768 and the like).

However, in the conventional developer removing apparatus stated in the above patent document, because the cleaning member contacts the charging roller in a state of compressing in a radius direction of the charging roller, the cleaning member is installed in an uneven position, specifically with respect to the radius direction of the charging roller. Thus, the amount by which the cleaning member is compressed can change greatly.

Thereby, in the case that the cleaning member is installed unevenly with respect to a direction approaching the charging roller, because the amount by which the cleaning member is compressed unnecessarily becomes large, abrasion of the cleaning member or load of the developer removing apparatus increases.

BRIEF SUMMARY OF THE INVENTION

It is, therefore, an object of the present invention to provide a developer removing apparatus capable of solving such problem of the abrasion or the load caused by the unevenness of the installation position of the cleaning member and capable of realizing excellent cleaning performance; and to provide an image forming apparatus comprising the developer removing apparatus.

According to the present invention, there is provided a sticking substance removing apparatus for removing a sticking substance sticking on a surface of an appointed rotating body, including:

a contacting member in the shape of a board has a first surface and a second surface and contacts the rotating body through the first surface; and a supporting section which supports the contacting member at least at an upstream side from a contact position between the rotating body and the contacting member with respect to a rotation direction of the rotating body, wherein the supporting section is formed so as to not contact the contacting member at least in an area of the second surface which is opposite to a contact part of the rotating body and the contacting member.

Moreover, in the sticking substance removing apparatus, the supporting section may support the contacting member at the upstream side and at a downstream side of a contact position between the rotating body and the contacting member with respect to a rotation direction of the rotating body.

Moreover, in the sticking substance removing apparatus, in the case that the first surface of the contacting member is in contact with the rotating body, in order to create a force which is applied to the contacting member from the rotating body in a radius direction of the rotating body release, the supporting section may include two supporting areas to respectively support the contacting member at the upstream side and at the downstream side of the contact position between the rotating body and the contacting member with respect to the rotation direction of the rotating body, and a predetermined space is formed by the two supporting areas.

Moreover, in the sticking substance removing apparatus, when setting a straight line distance corresponding to the contact part of the contacting member and the rotating body as a, setting a contact point approximately in center of the distance a P, and setting an interval between the two supporting areas along a tangent line of the rotating body passing through the contact point P as A, the supporting section may be formed so as to meet a relation of $A>a$. When setting a maximum projection amount of the contacting member caused by a pressure toward the radius direction of the rotating body at the contact point P as b, and setting a distance of the space of the supporting section in the radius direction of the rotating body at the contact point P as B, the supporting section may be formed so as to meet a relation of $B>b$.

Moreover, in the sticking substance removing apparatus, the supporting section supports the contacting member at the upstream side of the contact position between the rotating body and the contacting member with respect to the rotation direction of the rotating body; and the contacting member, when the first surface is in contact with the rotating body, may be formed so as to fall downwardly.

Moreover, the sticking substance removing apparatus may further comprise a reinforcing member which is sandwiched between the second surface of the contacting member and the supporting section, and is used to reinforce the contacting member.

Moreover, in the sticking substance removing apparatus, the reinforcing member may have a greater bend elasticity coefficient than the contacting member.

Moreover, in the sticking substance removing apparatus, the rotating body may be belt shaped.

Moreover, in the sticking substance removing apparatus, the rotating body may be a charging roller to charge an image carrying body, and the contacting member may remove the sticking substance sticking on the surface of the charging roller.

Further, according to the present invention, there is provided an image forming apparatus for forming an image onto an appointed record medium, including:

an image forming section to develop an electrostatic latent image formed on an image carrying body through a sticking substance, and to perform an image formation with respect to the record medium; and a sticking substance removing section to remove sticking substance sticking on surface of an appointed rotating body, wherein the sticking substance removing section includes:

a contacting member in the shape of a board which has a first surface and a second surface and contacts the rotating body through the first surface; and a supporting section which supports the contacting member at least at an upstream side of a contact position between the rotating body and the contacting member with respect to a rotation direction of the rotating body, the supporting section is formed so as to not contact the contacting member at least in an area of the second surface which is opposite to a contact part of the rotating body and the contacting member.

In the present invention, because the influence of abrasion or load caused by the uneven installation of the contacting member can be reduced, it is possible to realize an excellent cleaning performance.

The above and other objects and features of the present invention will become apparent from the following detailed description and the appended claims with reference to the accompanying drawings.

DETAILED DESCRIPTION OF THE INVENTION

The following is to explain in detail preferred embodiments to which the present invention is applied through referring to the appending drawings.

In the embodiments, an image forming apparatus includes a developer removing apparatus (i.e. sticking substance removing apparatus) to removing toner serving as developer (i.e. sticking substance) sticking on a surface of a charging roller formed from a rotating body. In the following, a color image forming apparatus of electrophotography form of tandem type will be explained, in which a plurality of image forming units furnishing respective image carrying bodies that correspond to respective colors are arranged in tandem.

Embodiment 1

Figure 1:
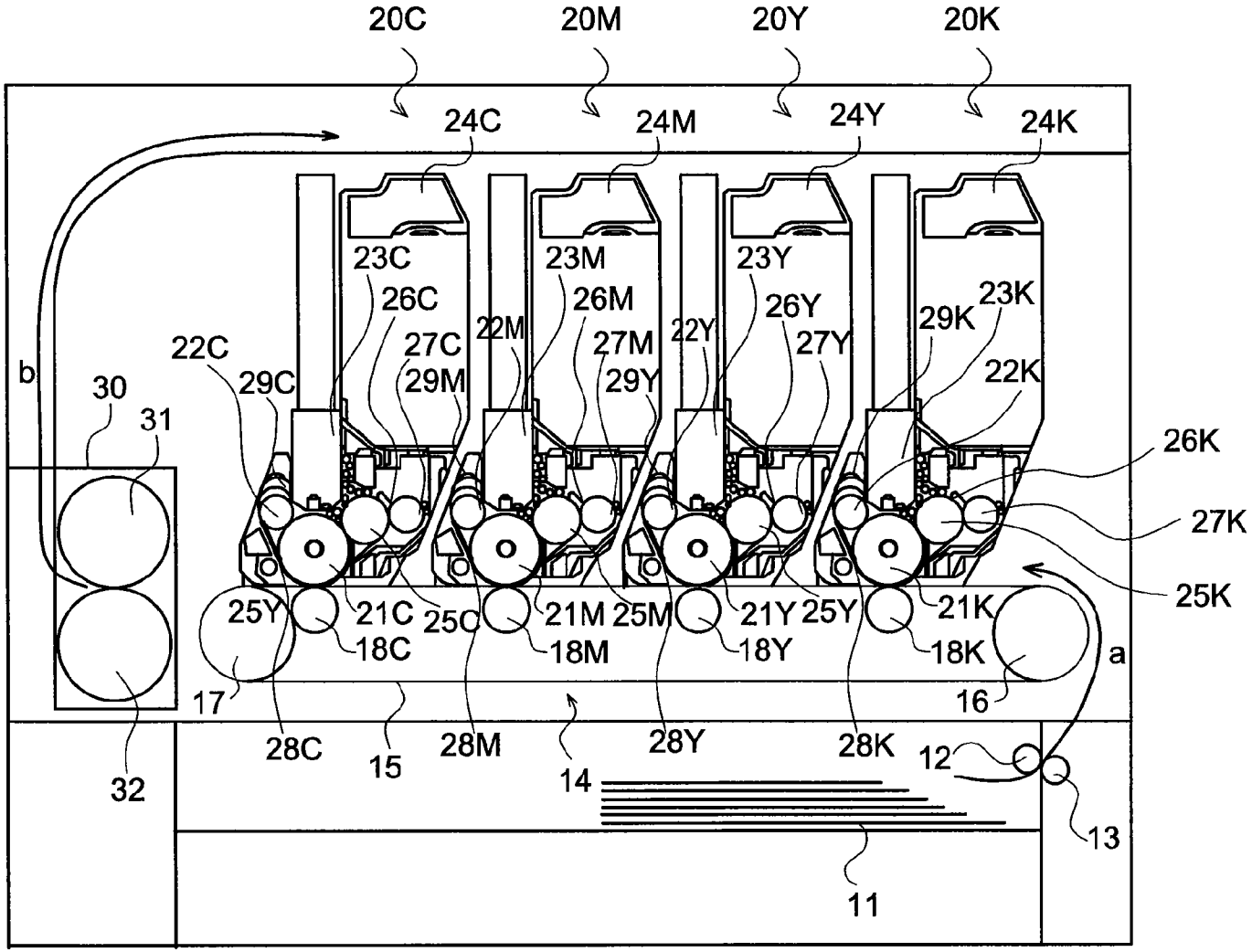
FIG. 1 is a cross sectional view showing a structure of an image forming apparatus in accordance with a preferred embodiment of the present invention.

An image forming apparatus is constructed as shown by FIG. 1. That is, the image forming apparatus comprises a paper providing tray 11 to accommodate record paper serving as record medium on which an image is not yet formed. The record paper accommodated in the paper providing tray 11 is sent out along a direction indicated by an arrow a in response to the rotations of paper providing rollers 12 and 13, and is conveyed in a predetermined timing to a transferring section 14 to form a medium conveyance route.

The transferring section 14 has a conveyance belt 15, a driving roller 16 which is driven by a belt motor (not shown), a belt idle roller 17 which rotates in response to movement of the conveyance belt 15 and provides tension so that the conveyance belt 15 does not occur relaxation, and transferring rollers 18K, 18Y, 18M, 18C to provide transfer voltages to image forming units 20K, 20Y, 20M, 20C that are attachable and removable, which are described in detail below. Moreover, the image forming units 20K, 20Y, 20M, 20C are sequentially arranged in tandem along the conveyance belt 15 toward a paper output side of the record paper from a paper providing side of the record paper. The image forming units 20K, 20Y, 20M, 20C covey the record paper by rotation forces of image carrying bodies 21K, 21Y, 21M, 21C and driving conveyance force of the conveyance belt 15, and also perform an image formation using respective colors with respect to the record paper put on the conveyance belt 15.

In operation, the image forming apparatus comprises the image forming units 20K, 20Y, 20M, 20C that are respectively facing to the transferring rollers 18K, 18Y, 18M, 18C so as to sandwich the conveyance belt 15 and respectively correspond to the four colors of black (K), yellow (Y), magenta (M) and cyan (C).

The image forming units 20K, 20Y, 20M, 20C have the respective image carrying bodies 21K, 21Y, 21M, 21C, each body includes an electroconductivity base layer made of, for example, Aluminum or the like and an outer layer made of organic photosensitive material. In circumferences of the image carrying bodies 21K, 21Y, 21M, 21C, respective charging rollers 22K, 22Y, 22M, 22C are furnished as respectively contacting the image carrying bodies 21K, 21Y, 21M, 21C. The charging rollers 22K, 22Y, 22M, 22C are respectively obtained by, for example, forming rubber material of semi-conductivity, such as epichlorohydrin rubber or the like, onto a metal shaft of electroconductivity in a roll shape. Providing positive voltage or negative voltage by a predetermined power source controlled by a controlling section (not shown) through the charging rollers 22K, 22Y, 22M, 22C makes the respective surfaces of the contacting image carrying bodies 21K, 21Y, 21M, 21C uniformly charged with electricity. Moreover, the image carrying bodies 21K, 21Y, 21M, 21C and the charging rollers 22K, 22Y, 22M, 22C are respectively arranged right and left along a rotation axis direction of the image carrying bodies 21K, 21Y, 21M, 21C, and respectively supported by a side frame (not shown).

Further, the image forming units 20K, 20Y, 20M, 20C comprise respective exposing sections 23K, 23Y, 23M, 23C. The exposing sections 23K, 23Y, 23M, 23C are furnished on the respective circumferences of the image carrying bodies 21K, 21Y, 21M, 21C, and have respective LED (Light Emitting Diode) heads to execute an exposure. The exposing sections 23K, 23Y, 23M, 23C respectively execute an exposure through irradiating light modulated on the basis of image data received from the outside onto the respective surfaces of the image carrying bodies 21K, 21Y, 21M, 21C, and respectively form an electrostatic latent image onto the respective image carrying bodies 21K, 21Y, 21M, 21C. Moreover, the exposing sections 23K, 23Y, 23M, 23C are supported by an upper cover member of the image forming apparatus. The upper cover member is operated to open or close when the image forming units 20K, 20Y, 20M, 20C or toner cartridges 24K, 24Y, 24M, 24C, respectively, are attached or removed with respect to the image forming apparatus.

Furthermore, the image forming units 20K, 20Y, 20M, 20C comprise respective developing rollers 25K, 25Y, 25M, 25C. The developing rollers 25K, 25Y, 25, 25C are furnished on the respective circumferences of the image carrying bodies 21K, 21Y, 21M, 21C and contact the respective image carrying bodies 21K, 21Y, 21M, 21C. The developing rollers 25K, 25Y, 25M, 25C are respectively obtained by forming rubber material of semi-conductivity, such as silicon or the like, onto a metal shaft of electroconductivity in roll shape. Providing positive voltage or negative voltage by a predetermined power source controlled by a controlling section (not shown) through the developing rollers 25K, 25Y, 25M, 25C develops the respective electrostatic latent images formed on the contacting image carrying bodies 21K, 21Y, 21M, 21C by using toners of respective colors.

Further, on the respective circumferences of the developing rollers 25K, 25Y, 25M, 25C, developing blades 26K, 26Y, 26M, 26C are furnished, the developing blades 26K, 26Y, 26M, 26C are respectively used to uniformly limit a toner thin layer on the respective developing rollers 25K, 25Y, 25M, 25C. Respective ends of the developing blades 26K, 26Y, 26M, 26C contact the respective developing rollers 25K, 25Y, 25M, 25C.

Furthermore, on the respective circumferences of the developing rollers 25K, 25Y, 25M, 25C, toner providing rollers 27K, 27Y, 27M, 27C are furnished. The toner providing rollers 27K, 27Y, 27M, 27C contact the respective developing rollers 25K, 25Y, 25M, 25C and respectively provide toner to the developing rollers 25K, 25Y, 25M, 25C. Moreover, the toner providing rollers 27K, 27Y, 27M, 27C are respectively obtained by forming a rubber material mixed foaming agent that is capable of improving conveyance ability of toner onto a metal shaft of electroconductivity in a roll shape. The toner providing rollers 27K, 27Y, 27M, 27C and the developing blades 26K, 26Y, 26M, 26C are provided with positive voltage or negative voltage by a predetermined power source. Moreover, the developing rollers 25K, 25Y, 25M, 25C, the developing blades 26K, 26Y, 26M, 26C, and the toner providing rollers 27K, 27Y, 27M, 27C are respectively arranged to the right and left along a rotation axis direction of the developing rollers 25K, 25Y, 25M, 25C, and respectively supported by a side frame (not shown).

Further, the image forming units 20K, 20Y, 20M, 20C comprise respective cleaning blades 28K, 28Y, 28M, 28C. The cleaning blades 28K, 28Y, 28M, 28C are furnished on the respective circumferences of the image carrying bodies 21K, 21Y, 21M, 21C and contact the respective image carrying bodies 21K, 21Y, 21M, 21C. The cleaning blades 28K, 28Y, 28M, 28C remove transfer-residual toners that are respectively remaining on the surfaces of the image carrying bodies 21K, 21Y, 21M, 21C.

Furthermore, the image forming units 20K, 20Y, 20M, 20C comprise respective cleaning sections 29K, 29Y, 29M, 29C. The cleaning sections 29K, 29Y, 29M, 29C, as a developer removing apparatus, are furnished on the respective circumferences of the charging rollers 22K, 22Y, 22M, 22C and contact the respective charging rollers 22K, 22Y, 22M, 22C. When the transfer-residual toners, which cannot be removed from the respective surfaces of the image carrying bodies 21K, 21Y, 21M, 21C by the cleaning blades 28K, 28Y, 28M, 28C, reach the respective surfaces of the charging rollers 22K, 22Y, 22M, 22C that are placed at downstream positions in respective rotation direction of the image carrying bodies 21K, 21Y, 21M, 21C, and adhere thereon, the cleaning sections 29K, 29Y, 29M, 29C remove the respective adhering toners.

Through the image forming units 20K, 20Y, 20M, 20C toner images of respective colors are formed. Then, through a control of a control section (not shown) and the transferring rollers 18K, 18Y, 18M, 18C, with the respective rotations of the image carrying bodies 21K, 21Y, 21M, 21C, the toner image of respective colors are sequentially stacked and transferred on a record paper.

In the image forming apparatus, through the image forming units 20K, 20Y, 20M, 20C and the transferring section 14, image formations of respective colors are sequentially formed on the record paper, and a color image is formed. Then, while being electrostatically attracted to the conveyance belt 15, the record paper is conveyed to a fixing section 30 which is placed in a downstream position of the image forming units 20K, 20Y, 20M, 20C.

The fixing section 30 has a fixing roller 31, which, for example, is formed by gluing an elastic member on outer surface of a hollow roller of metal, and a pressing roller 32 for pressing the record paper together with the fixing roller 31. The pressing roller 32 is furnished as facing the fixing roller 31 and in contact with the fixing roller 31, and further forms a nip portion to sandwich the record paper. Further, in the inside of the fixing roller 31, a halogen lamp emits light through a power source (not shown). In the fixing section 30, under a control of a controlling section (not show) and from the light emitted from the halogen lamp, the fixing roller 31 is heated. The fixing section 30 makes the fixing roller 31 and the pressing roller 32 rotate in order to make the record paper pass through the nip portion. Through heating and pressing the record paper, toner on the record paper melts and heatedly fixes a toner image. In the image forming apparatus, when the toner image is fixed on the record paper by such fixing section 30, through an electing roller (not show), the record paper is conveyed toward a direction shown by an arrow b (FIG. 1) and is ejected to outside, then is stacked on a predetermined stacker (not shown).

Moreover, because the image forming units 20K, 20Y, 20M, 20C, as stated above, use the toners with different colors but have the same structure, as a matter of convenience, below mark excluding the marks K, Y, M and C is used.

Figure 2:
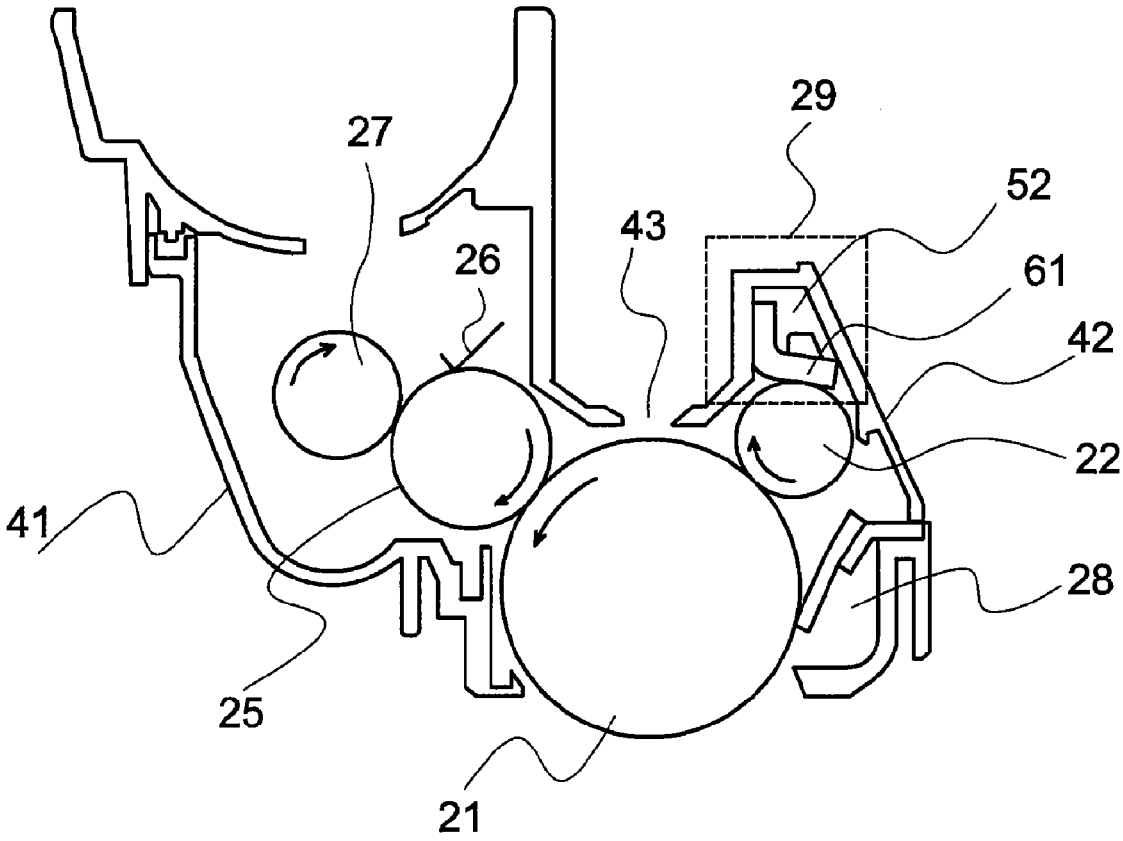
FIG. 2 is a front view diagram showing a structure of an image forming unit in an image forming apparatus in accordance with a preferred embodiment of the present invention.
Figure 3:
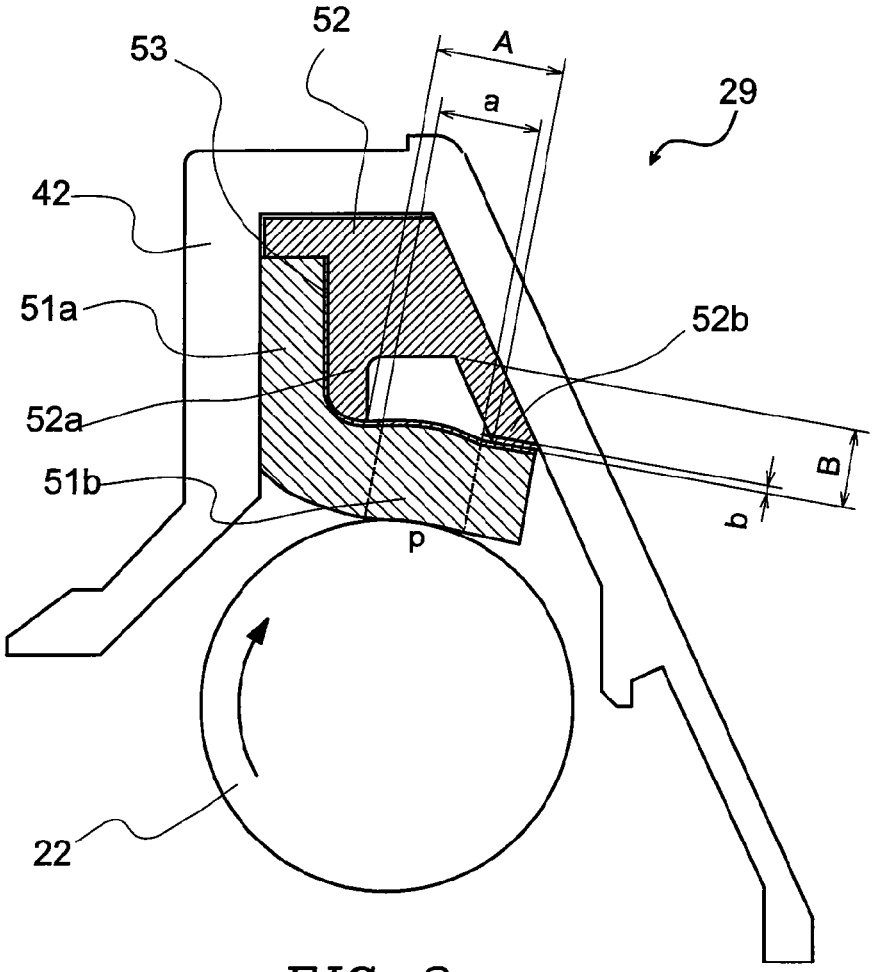
FIG. 3 is a front view diagram showing a portion obtained by magnifying the circumference of a cleaning member in an image forming unit in FIG. 2.

The respective composition members of a single image forming unit 20 in the image forming apparatus, as shown by FIGS. 2 and 3, are covered by a covering member 42 supported by a base frame member 41. On the covering member 42, in order to expose the image carrying body 21 by the exposing section 23, an opening portion 43 is furnished in a position which is downstream of the charging roller 22 and is upstream of the developing roller 25. Further, on the covering member 42, the cleaning section 29, serving as the developer removing apparatus, is formed.

The cleaning section 29, as shown by FIG. 3, has a cleaning member 51 (FIG. 4), which serves as a contacting member to contact the charging roller 22, and a fixing member 52 to fix the cleaning member 51. The cleaning member 51, for example, is adhesively fixed to the fixing member 52 via a two-sided tape. Moreover, in the present embodiment, the covering member 42 and the fixing member 52 form a supporting section to support the cleaning member 51.

The cleaning member 51, which is in the shape of a board, has a first surface and a second surface and contacts the surface of the charging roller 22 through the first surface. Specifically, one edge 51*a* of the cleaning member 51 adheres to the fixing member 52 and is sandwiched between the covering member 42 and the fixing member 52. Further, a board shape plane portion 51*b* of the cleaning member 51 contacts the surface of the charging roller 22. Moreover, the one edge 51*a* of the cleaning member 51 is placed at an upstream side of a contact position between the charging roller 22 and the cleaning member 51 with respect to the rotation direction of the charging roller 22.

The fixing member 52 has a first fixation foot portion 52*a*, which is placed at an upstream side of a contact position between the charging roller 22 and the cleaning member 51 with respect to the rotation direction of the charging roller 22, and a second fixation foot portion 52*b*, which is placed at a downstream side of a contact position between the charging roller 22 and the cleaning member 51 with respect to the rotation direction of the charging roller 22. Through the first fixation foot portion 52*a* and the second fixation foot portion 52*b*, the cleaning member 51 can be adhesively supported. Here, in the case that the board shape plane portion 51*b* of the cleaning member 51 contacts the charging roller 22, in order to make a force in roller radius direction applied onto the cleaning member 51 from the charging roller 22 release to a space formed between the fixation foot portions 52*a* and 52*b*, the fixing member 52, for example, is formed in a concave shape.

That is, as shown by FIG. 3, when setting a straight line distance of a range in which the cleaning member 51 contacts the charging roller 22 into a, a contact point in an approximate center of the distance a into P, and setting an interval between the first fixation foot portion 52*a* and the second fixation foot portion 52*b* along a tangent line direction of the charging roller 22 at the contact point P into a distance A, the fixing member 52 is formed so that the distance A is greater than the distance a. Further, the fixing member 52 is formed so that a length of the space formed by the fixation foot portions 52*a* and 52*b* in the radius direction of the charging roller 22 is bigger than a maximum projection quantity of the cleaning member 51 caused by a pressure of the charging roller 22 at the contact point P. For example, in the fixing member 52 whose shape is shown by FIG. 3, if setting the maximum projection quantity of the cleaning member 51 caused by a pressure of the charging roller 22 at the contact point P into b, and setting the distance of the concave portion of the fixing member 52 in the radius direction of the charging roller 22 at the contact point P into B, the distance B is greater than the distance b.

In the present embodiment, in the case that the diameter of the charging roller 22 is 12 mm, the length of A is 4 mm (A=4 mm), the length of a is 3 mm (a=3 mm), the length of B is 3 mm (B=3 mm), and the length of b is 0.8 mm (b=0.8 mm). Moreover, if only the fixing member 52 has such space to meet the relations of A>a and B>b, other shapes excluding the concave shape may be used. That is, in the fixing member 52, the area which corresponds to the contact range of the charging roller 22 and the cleaning member 51 and faces the second surface of the cleaning member 51 does not contact the cleaning member 51.

Figure 4:
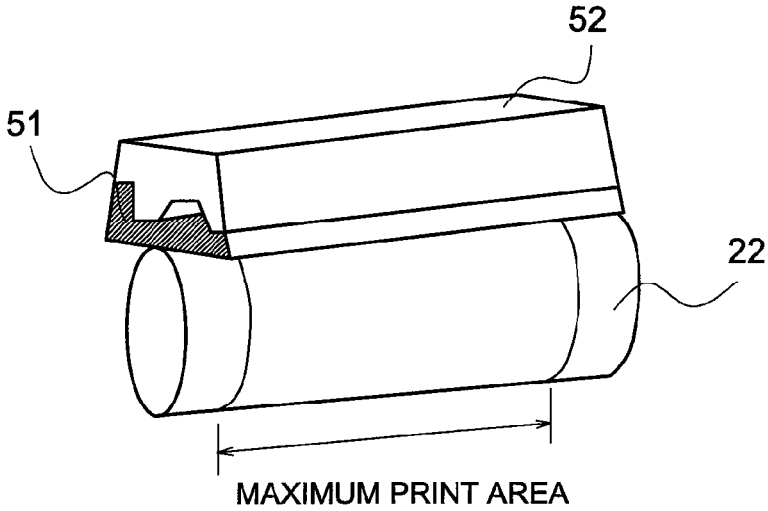
FIG. 4 is a perspective view diagram to explain an arrangement of a cleaning member and a fixing member with respect to a charging roller in an image forming apparatus in accordance with a preferred embodiment of the present invention.

The cleaning member 51 and the fixing member 52, as shown by FIG. 4, are furnished along the longitudinal direction of the charging roller 22. In this case, the cleaning member 51 contacts the charging roller 22 more along a length than a width of maximum print area of the record paper.

Figure 5:
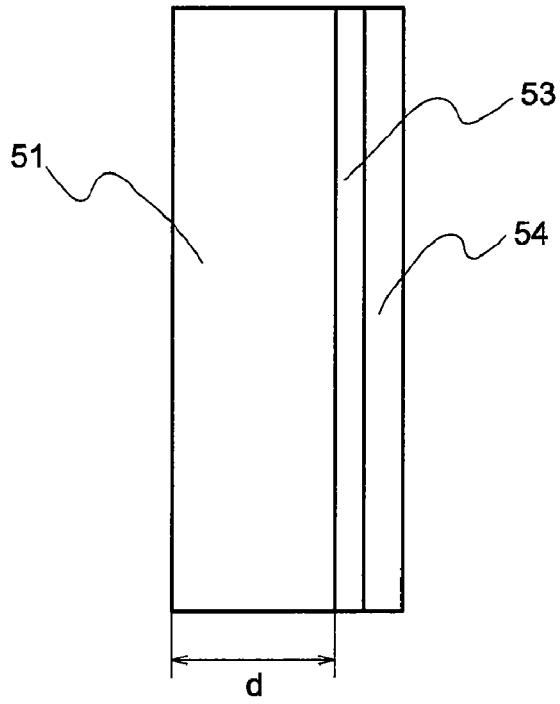
FIG. 5 is a side view diagram showing a cleaning member in an image forming apparatus in accordance with a preferred embodiment of the present invention.

The cleaning member 51, as shown by FIG. 5, can be formed by using a sponge material of polyester type whose thickness d is, for example, 3 mm (d=3 mm) and which is excellent to resist abrasion and resist climate changes. Moreover, the cleaning member 51 may be formed from a material having the same properties as the sponge material of polyester type, for example, felt material or any other material can be used. Further, on one surface of the cleaning member 51, a two-sided tape 53 with an exfoliation paper 54 is stuck over the whole surface. When the two-sided tape 53 adheres to the fixing member 52, the exfoliation paper 54 is exfoliated. Moreover, the structure of the two-sided tape 53 is acceptable if only a part is adhered with respect to the fixing member 52. Further, in the present embodiment, the fixation method of the cleaning member 51 with respect to the fixing member 52 is not limited by the two-sided tape 53.

In the cleaning section 29, through forming the space of concave shape between the first fixation foot portion 52*a* and the second fixation foot portion 52*b* in the fixing member 52, with respect to the radius direction of the charging roller 22, even if the installation position of the cleaning member 51 is uneven and the cleaning member 51 is installed in a direction that approaches the charging roller 22, because the force adding onto the board shape plane portion 51*b* of the cleaning member 51 escapes toward the radius direction of the charging roller 22, the amount by which the board shape plane portion 51*b* is compressed does not become large. That is, in the cleaning member 51, through its own elasticity, the board shape plane portion 51*b* contacts the charging roller 22.

The applicant of the present invention executed an experimentation and obtained a relation between a displacement quantity of the installation position of the cleaning member 51 with respect to the radius direction of the charging roller 22 and a load torque of the image carrying body 21 caused by a contact of the cleaning member 51 and the charging roller 22. Moreover, in the experimentation, an installation position of the cleaning member 51 was measured when a load torque of the image carrying body 21 becomes "0", and the installation position was decided to serve as a reference position whose displacement quantity is "0". Then, in the case that the installation position of the cleaning member 51 displaces from the standard position toward the direction approaching the charging roller 22, the displacement quantity was obtained as a positive value displacement quantity. An experimental result is shown by FIG. 6.

Figure 6:
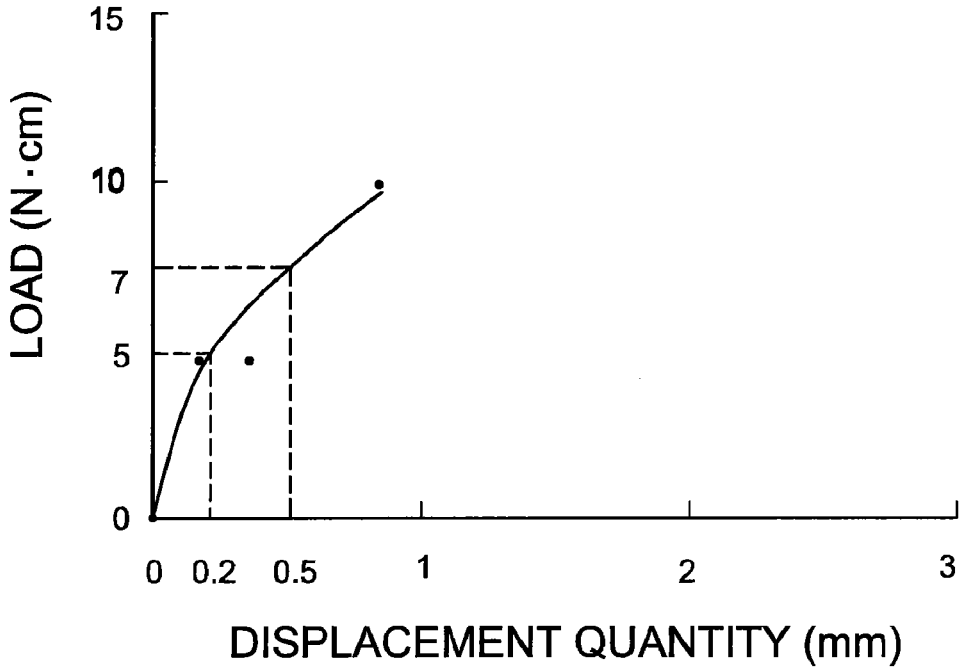
FIG. 6 is a coordinate diagram showing an experiment result obtained by charting a relation between a displacement quantity of an installation position of a cleaning member with respect to a radius direction of a charging roller and a load torque of an image carrying body which occurs through a cleaning member to contact in the case to use the cleaning member shown by FIGS. 2-5.

As seen in FIG. 6, the displacement quantity of the installation position of the cleaning member 51 with respect to the radius direction of the charging roller 22 is indicated by a horizontal axis, and the load torque of the image carrying body 21 caused through a cleaning member to contact is indicated by a vertical axis.

Figure 7:
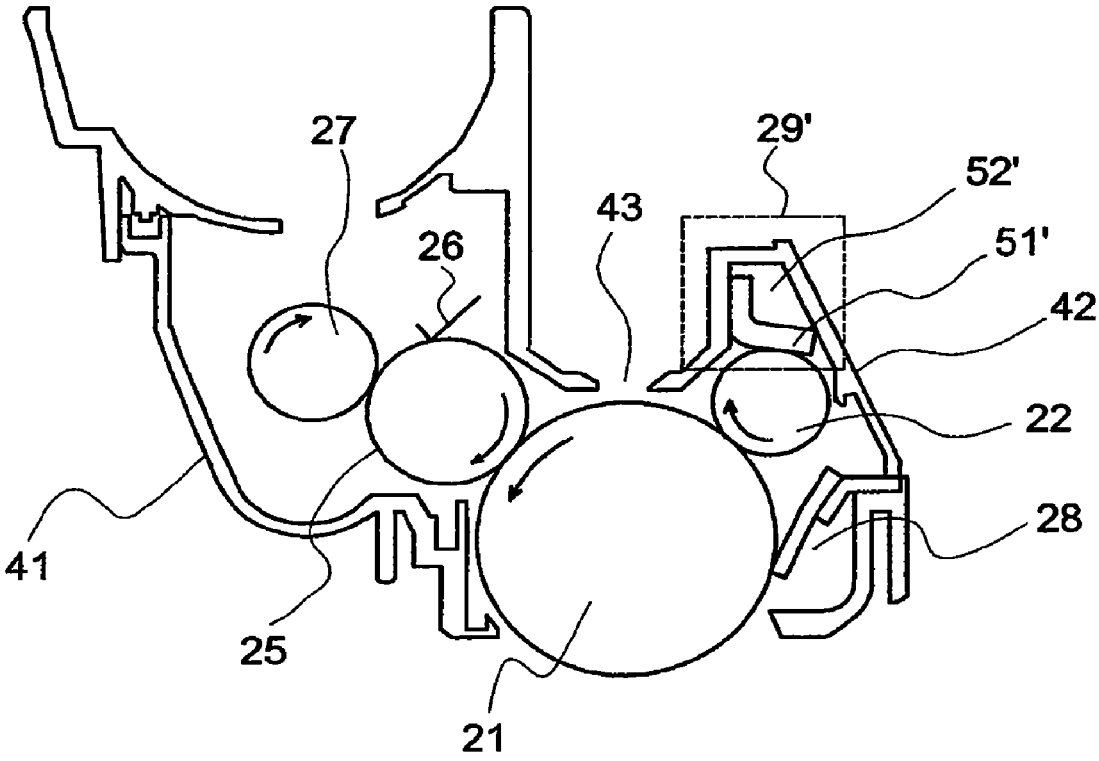
FIG. 7 Prior Art
FIG. 7 is a front view diagram showing a structure of an image forming unit in a conventional image forming apparatus.
Figure 8:
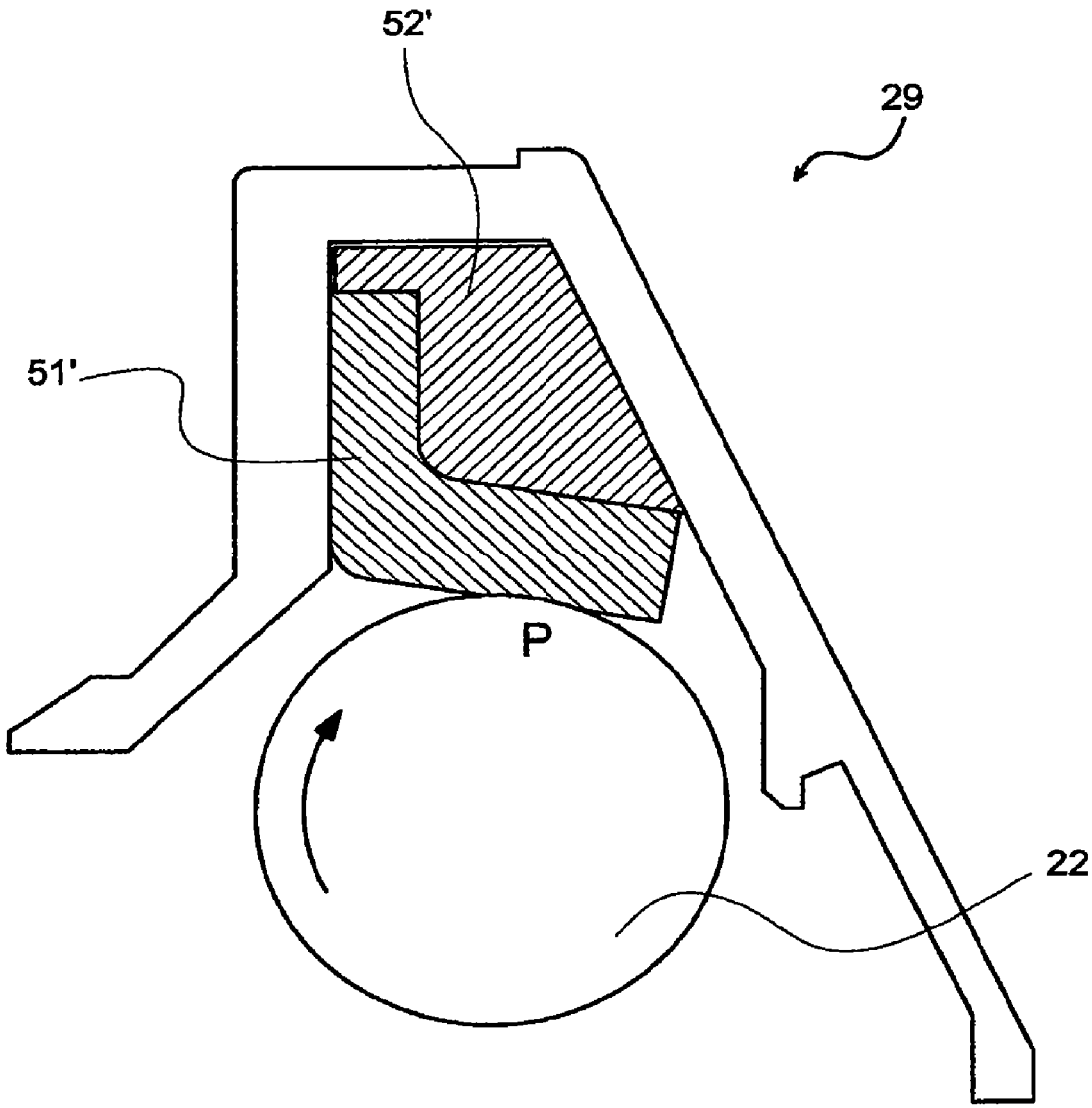
FIG. 8 Prior Art
FIG. 8 is a front view diagram showing a portion obtained by magnifying the circumference of a cleaning member in an image forming unit in FIG. 7.

Further, in order to compare with the experimental result shown by FIG. 6, the applicant of the present invention made a cleaning section 29' (FIG. 7) and made the same experiment. As seen in FIG. 7, in the cleaning section 29', a fixing member 52' is formed with a shape having no the concave portion stated above, and a cleaning member 51' and the fixing member 52' are in contact overall along the surfaces. The cleaning section 29' is used in conventional image forming apparatus, because the fixing member 52' has the shape without the concave portion, the cleaning member 51' is to compressively contact with the charging roller 22. An experiment result in this case is shown by FIG. 9.

Figure 9:
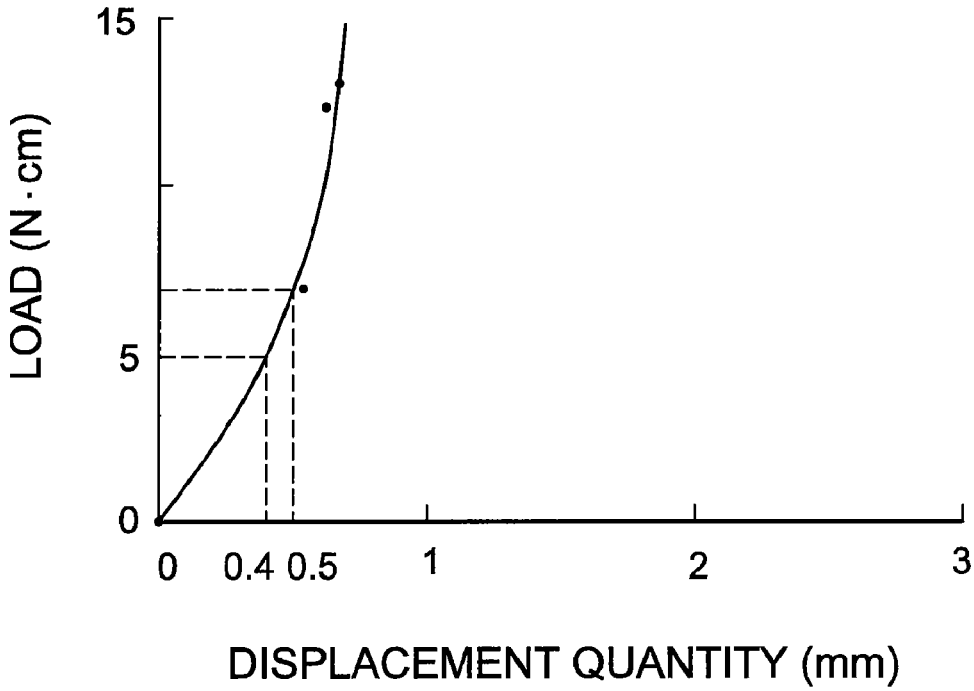
FIG. 9 is a coordinate diagram showing an experiment result obtained by charting a relation between a displacement quantity of an installation position of a cleaning member with respect to a radius direction of a charging roller and a load torque of an image carrying body which occurs through a cleaning member to contact in the case to use the cleaning member shown by FIGS. 7-8.

When comparing FIG. 6 with FIG. 9, in the case of the cleaning section 29 of the present embodiment, the inclination of the displacement quantity of the installation position of the cleaning member 51 with respect to the load torque of the image carrying body 21 is small, and even if the installation position is uneven, the change of the load torque of the image carrying body 21 is small. That is, in the image forming apparatus, as compared with the conventional image forming apparatus having the same displacement quantity, through using the cleaning section 29, the apparatus load is lightened, so that the influence to add the load caused by the unevenness of the installation position of the cleaning member 51 can be reduced.

In fact, in the image forming apparatus of the present embodiment, the load torque of the image carrying body 21 is in a range of 5~7 N·cm. Then to observe the experiment result on the basis of such load torque, in the experiment result of FIG. 9, as the displacement quantity to meet that the load torque of the image carrying body 21 is in a range of 5~7 N·cm, it only is in a range of 0.5~0.4 mm. That is, the unevenness of the displacement quantity is only limited within 0.1 mm. With respect to this, in the experiment result of FIG. 6, as the displacement quantity to meet that the load torque of the image carrying body 21 is in a range of 5~7 N·cm, it is in a range of 0.5~0.2 mm. That is, the unevenness of the displacement quantity is limited within 0.3 mm, is greater than the 0.1 mm. Thereby, in the image forming apparatus, through using the cleaning section 29, it is possible to improve the margin of the installation position of the cleaning member 51.

Further, in the image forming apparatus of the present embodiment, through using the cleaning section 29, a force that presses against the charging roller 22 becomes small, so that it is possible to prevent the charging roller 22 from being damaged and to inhibit the abrasion.

Furthermore, in the image forming apparatus, because the one edge 51*a* of the cleaning member 51 is placed at upstream side of a contact position between the charging roller 22 and the cleaning member 51 with respect to the rotation direction of the charging roller 22, even if the cleaning member 51 is deformed towards the downstream side of the rotation direction of the charging roller 22 due to the rotation of the charging roller 22, it is possible to keep in contacting state and to certainly clean the surface of the charging roller 22.

As stated above, in the image forming apparatus of the preferred embodiment 1 of the present invention, making the cleaning member 51 contact the charging roller 22 by the bend elasticity of the cleaning member 51, the influence of abrasion or load caused by any uneven installation of the cleaning member 51 can be reduced, so that it is possible to realize an excellent cleaning performance.

Embodiment 2

The image forming apparatus of the preferred embodiment 2 of the present invention is obtained by improving the image forming apparatus of the preferred embodiment 1 of the present invention and by changing the shape of the fixing member that constructs the cleaning section. Therefore, in the explanation of the preferred embodiment 2, like reference numerals will be used to identify like elements throughout and their detailed explanation will be omitted.

Figure 10:
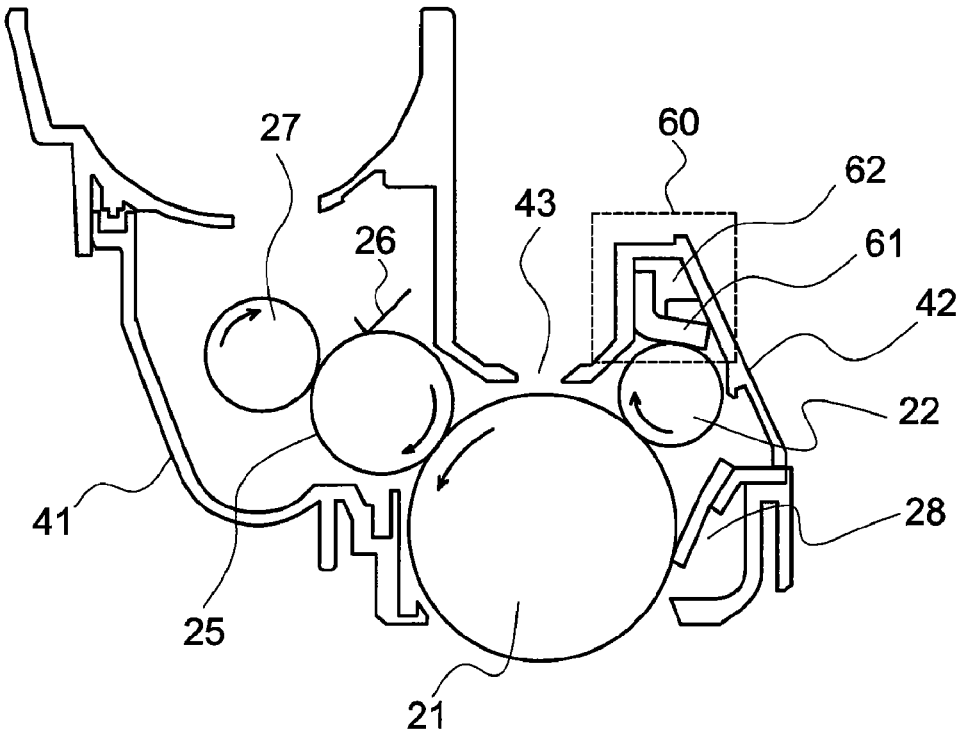
FIG. 10 is a front view diagram showing a structure of an image forming unit in an image forming apparatus in accordance with a preferred embodiment of the present invention.

The image forming unit 20 of the preferred embodiment 2 of the image forming apparatus has a cleaning section 60. The cleaning section 60, as shown by the FIGS. 10 and 11, is formed on the covering member 42 as the developer removing apparatus stated above.

Figure 11:
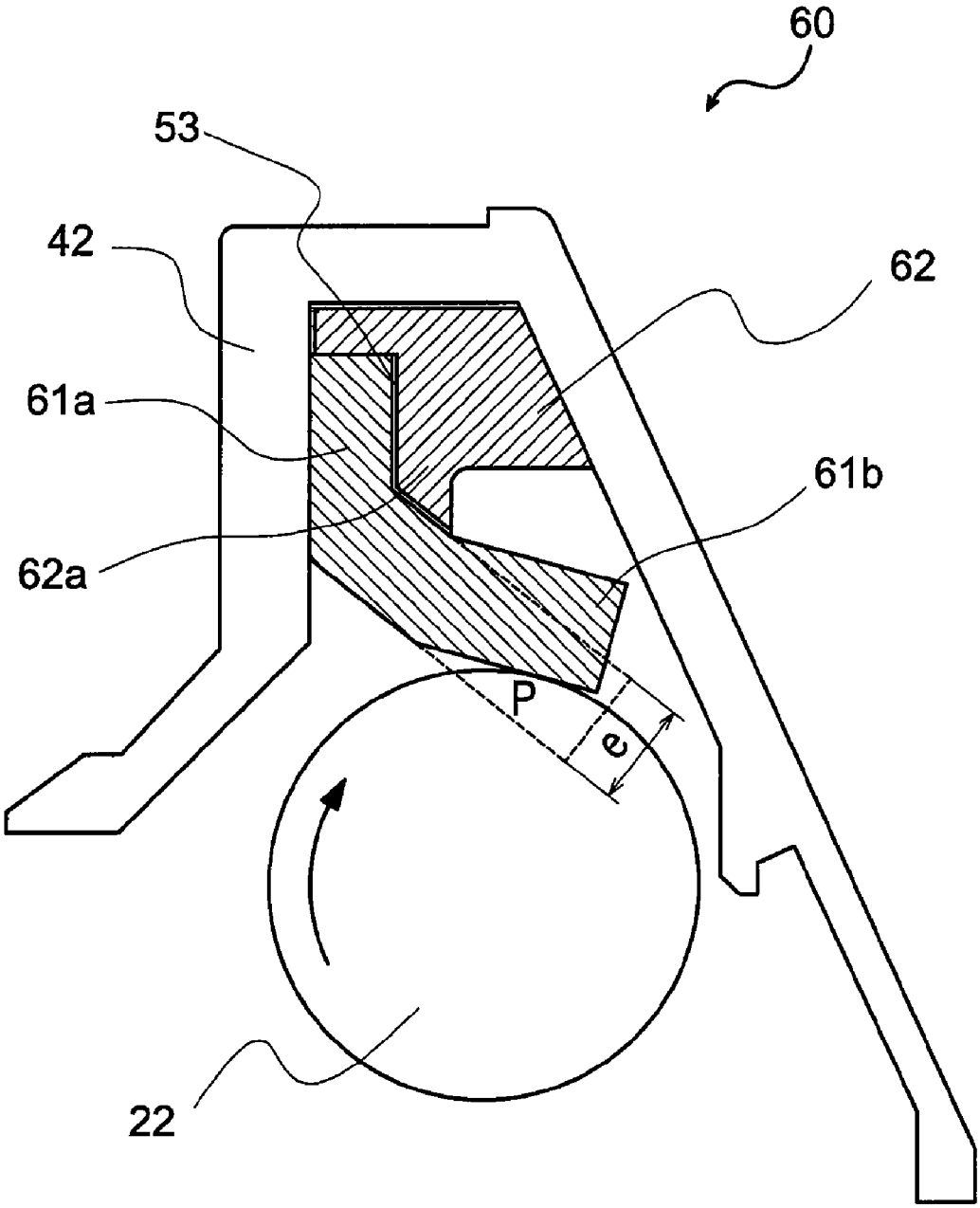
FIG. 11 is a front view diagram showing a portion obtained by magnifying the circumference of a cleaning member in an image forming unit in FIG. 10.

The cleaning section 60, as shown by FIG. 11, has a cleaning member 61, which serves as a contacting member to contact the charging roller 22, and a fixing member 62 to fix the cleaning member 61. The cleaning member 61, for example, is adhesively fixed by the fixing member 62 via the two-sided tape 53. Moreover, in the embodiment, the covering member 42 and the fixing member 62 forms a supporting section to support the cleaning member 61.

The cleaning member 61, which is in the shape of a board, has a first surface and a second surface and contacts the surface of the charging roller 22 through the first surface. Specifically, one edge 61*a* of the cleaning member 61 adheres to the fixing member 62 and is sandwiched between the covering member 42 and the fixing member 62. Further, a board shape plane portion 61*b* of the cleaning member 61 contacts the surface of the charging roller 22. The board shape plane portion 61*b*, when contacting the charging roller 22, as shown by a broken line in the same drawing, falls down toward the radius direction of the charging roller 22. Moreover, the one edge 61*a* of the cleaning member 61 is placed at an upstream side of a contact position between the charging roller 22 and the cleaning member 61 with respect to the rotation direction of the charging roller 22.

The fixing member 62 has a fixation foot portion 62*a*. Through the fixation foot portion 62*a*, the fixing member 62 has a shape enabling the cleaning member 61 to be adhesively supported. Moreover, the fixation foot portion 62*a* is placed at an upstream side of a contact position between the charging roller 22 and the cleaning member 61 with respect to the rotation direction of the charging roller 22.

The cleaning member 61 and the fixing member 62, as the cleaning member 51 and the fixing member 52 shown by FIG. 4, are furnished along the longitudinal direction of the charging roller 22. Specifically, the cleaning member 61 contacts the charging roller 22 more along a length than a width of maximum print area of the record paper.

Figure 12:
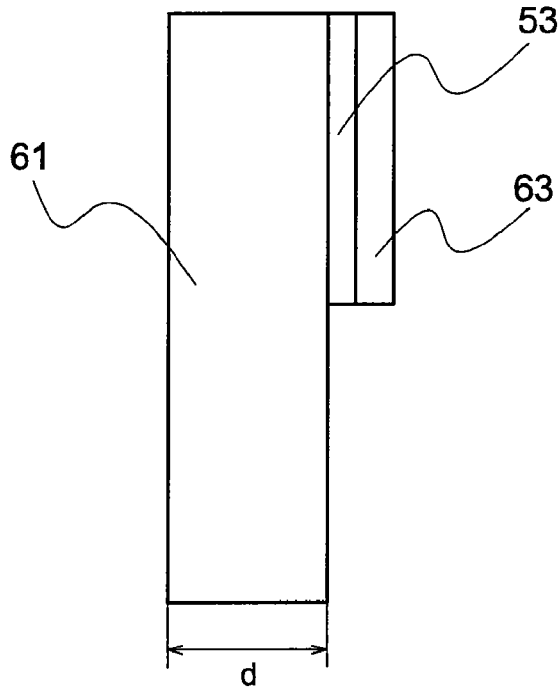
FIG. 12 is a side view diagram showing a cleaning member in an image forming apparatus in the embodiment of FIG. 10 of the present invention.

Referring to FIG. 12, the cleaning member 61, as the cleaning member 51 of the preferred embodiment 1, can be formed by using sponge material of polyester type which is excellent to resist abrasion and resist climate changes. Further, on one surface of the cleaning member 61, a two-sided tape 53 with an exfoliation paper 54 is stuck partly. When the two-sided tape 53 adheres to the fixing member 62, the exfoliation paper 54 is exfoliated. The sticking range of the two-sided tape 53 is set into a size to correspond to the sticking surface of the fixing member 62. Moreover, in the present invention, the fixation method of the cleaning member 61 with respect to the fixing member 62 is not limited by the two-sided tape 53. In the embodiment, in the case that the diameter of the charging roller 22 is 12 mm, the thickness d of the cleaning member 61 is 3 mm. When the board shape plane portion 61*b* of the cleaning member 61 falls downward the radius direction of the charging roller 22, the bend quantity e of the edge of the cleaning member 61 is 2.5 mm.

In the cleaning section 60, through forming a space between the fixation foot portion 62*a* and the covering member 42; forming the fixing member 62 so as to not contact the cleaning member 61 in the area of the second surface opposite to the contact part between the charging roller 22 and the cleaning member 61; and forming the cleaning member 61 so as to fall downwardly the radius direction of the charging roller 22 in the case that the board shape plane portion 61*b* contacts the surface of the charging roller 22, with respect to the radius direction of the charging roller 22, even if the installation position of the cleaning member 61 is uneven and the cleaning member 61 is installed in a direction approaching the charging roller 22, because the force applied onto the board shape plane portion 61*b* of the cleaning member 61 releases toward the radius direction of the charging roller 22, the amount by which of the board shape plane portion 61*b* is compressed does not become large. That is, in the cleaning member 61, through its own elasticity, the board shape plane portion 61*b* contacts the charging roller 22.

The applicant of the present invention executed an experimentation and obtained a relation between a displacement quantity of the installation position of the cleaning member 61 with respect to the radius direction of the charging roller 22 and a load torque of the image carrying body 21 caused by a contact of the cleaning member 61 and the charging roller 22. Moreover, in the experimentation, an installation position of the cleaning member 61 was measured when a load torque of the image carrying body 21 became "0", and the installation position was decided to serve as a reference position whose displacement quantity was "0". Then, in the case that the installation position of the cleaning member 61 displaces from the reference position toward the direction approaching the charging roller 22, the displacement quantity was obtained as positive value displacement quantity. An experimental result is shown by FIG. 13.

Figure 13:
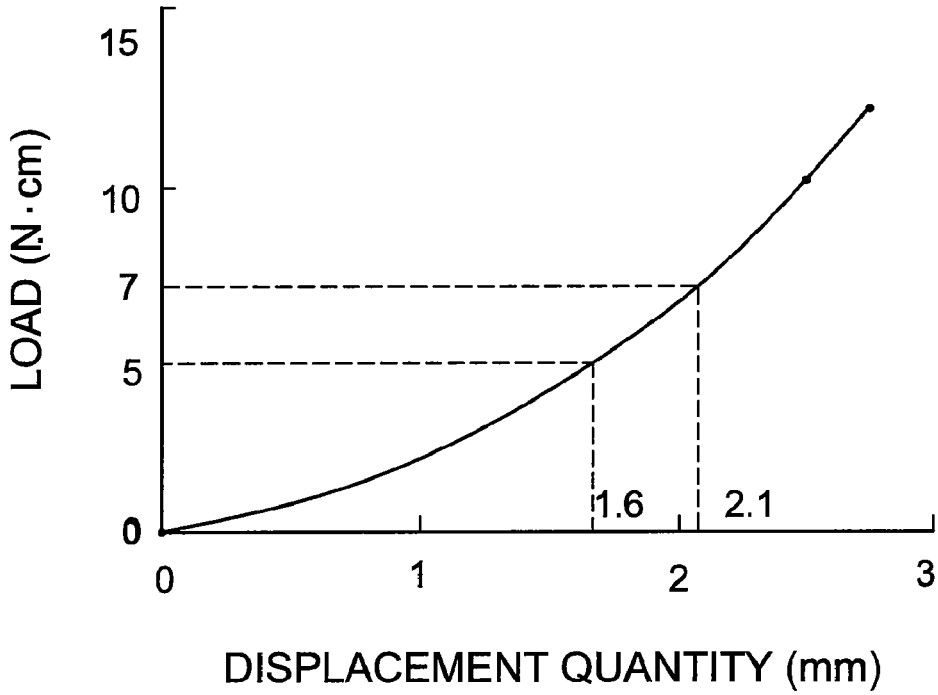
FIG. 13 is a coordinate diagram showing an experiment result obtained by charting a relation between a displacement quantity of an installation position of a cleaning member with respect to a radius direction of a charging roller and a load torque of an image carrying body which occurs through a cleaning member to contact in the case to use the cleaning member shown by FIGS. 10-12.

In the FIG. 13, the displacement quantity of the installation position of the cleaning member 61 with respect to the radius direction of the charging roller 22 is indicated by a horizontal axis, and the load torque of the image carrying body 21 caused through a cleaning member to contact is indicated by a vertical axis.

When comparing FIG. 13 with FIG. 6 of the preferred embodiment 1, in the case of the cleaning section 60 in the present embodiment, the inclination of the displacement quantity of the installation position of the cleaning member 61 with respect to the load torque of the image carrying body 21 is small, and even if the installation position is uneven, the change of the load torque of the image carrying body 21 is smaller. That is, in the image forming apparatus of the present embodiment, through using the cleaning section 60, as compared with the conventional image forming apparatus having the same displacement quantity, the apparatus load is lightened, so that the influence to add the load caused by the unevenness of the installation position of the cleaning member 61 can be reduced.

Further, if observing the experiment result from the apparatus load, we can know that: in the experiment result shown by the FIG. 13, as a displacement quantity to meet that the load torque of the image carrying body 21 is in a range of 5~7 N·cm, it only is in a range of 2.1~1.6 mm. That is, the unevenness of the displacement quantity is limited within 0.5 mm. Thereby, as compared with the preferred embodiment 1, it is possible to more improve the margin of the installation position of the cleaning member 61.

Further, in the image forming apparatus of the present embodiment, when using the cleaning section 60, a force that presses against the charging roller 22 becomes small, so that it is possible to prevent the charging roller 22 from being damaged and to inhibit the abrasion.

Furthermore, in the image forming apparatus of the present embodiment, because the one edge 61*a* of the cleaning member 61 is placed at an upstream side of a contact position between the charging roller 22 and the cleaning member 61 with respect to the rotation direction of the charging roller 22, even if the cleaning member 61 is deformed towards the downstream side of the rotation direction of the charging roller 22 due to the rotation of the charging roller 22, it is possible to keep in contacting state and to certainly clean the surface of the charging roller 22.

As stated above, in the image forming apparatus of the preferred embodiment 2 of the present invention, the influence of abrasion or load caused by any uneven installation of the cleaning member 61 can be reduced, so that it is possible to realize an excellent cleaning performance.

Embodiment 3

The image forming apparatus of the preferred embodiment 3 of the present invention is obtained by improving the image forming apparatus in the preferred embodiment 2 of the present invention and by changing the structure of the cleaning section. Therefore, in the explanation of the embodiment 3, like reference numerals will be used to identify like elements throughout and their detailed explanation will be omitted.

Figure 14:
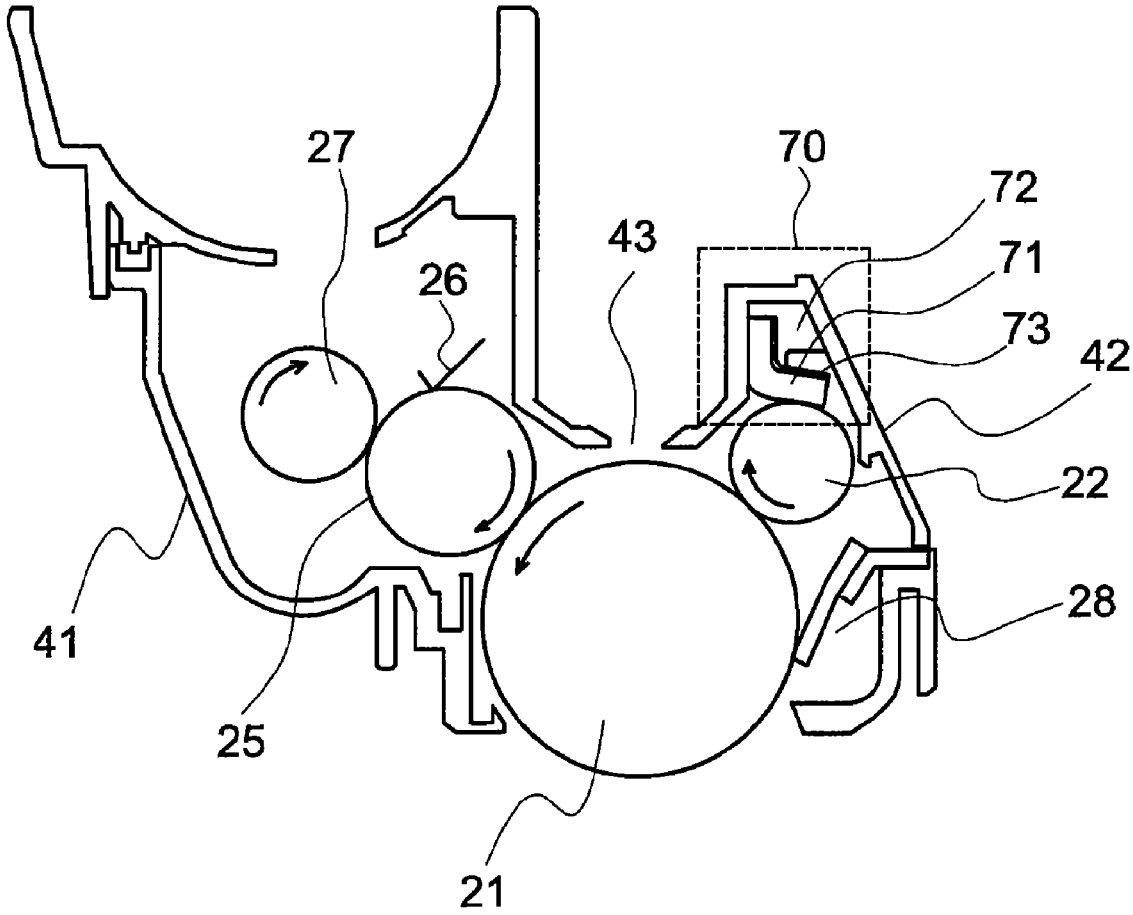
FIG. 14 is a front view diagram showing a structure of an image forming unit in an image forming apparatus in accordance with a preferred embodiment of the present invention.

The image forming unit 20 of the image forming apparatus of the present embodiment has a cleaning section 70. The cleaning section 70, as shown by the FIGS. 14 and 15, is formed on the covering member 42 as the developer removing apparatus stated above.

Figure 15:
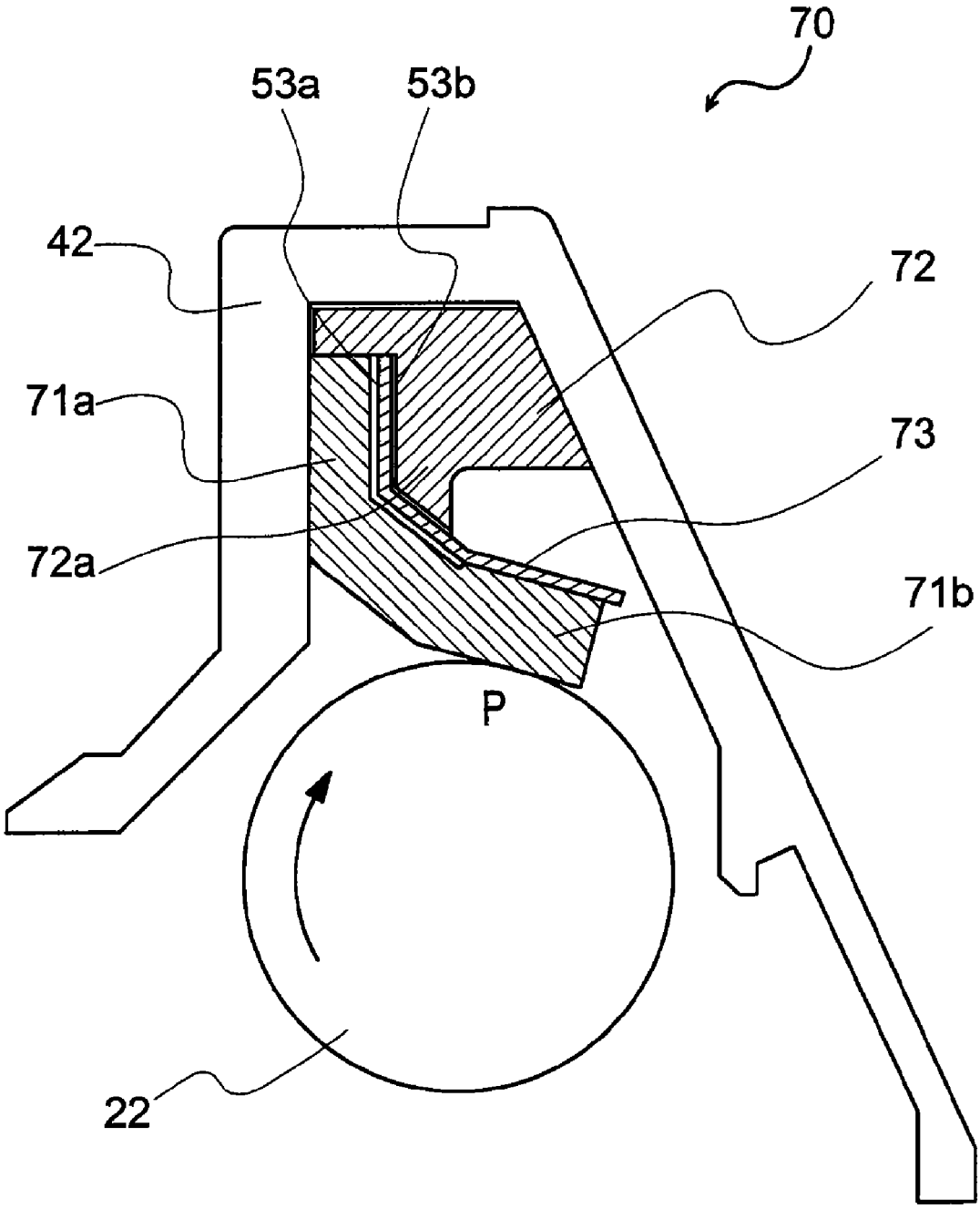
FIG. 15 is a front view diagram showing a portion obtained by magnifying the circumference of a cleaning member in an image forming unit in FIG. 14.

The cleaning section 70, as shown by FIG. 15, has a cleaning member 71, which serves as a contacting member to contact the charging roller 22, a fixing member 72 to fix the cleaning member 71, and a film member 73 which is placed between the cleaning member 71 and the fixing member 72 and serves as a reinforcing member to reinforce the cleaning member 71. The cleaning member 71, for example, is adhesively fixed by the film member 73 via the two-sided tape 53*a*. Moreover, in the embodiment, the covering member 42, the fixing member 72 and the film member 73 form a supporting section to support the cleaning member 71.

The cleaning member 71, which is in the shape of a board, has a first surface and a second surface and contacts the surface of the charging roller 22 through the first surface. Specifically, one edge 71*a* of the cleaning member 71 adhered to the fixing member 72 and is sandwiched between the covering member 42 and the film member 73. Further, a board shape plane portion 71*b* of the cleaning member 71 contacts the surface of the charging roller 22. Moreover, the one edge 71*a* of the cleaning member 71 is placed at an upstream side of a contact position between the charging roller 22 and the cleaning member 71 with respect to the rotation direction of the charging roller 22.

The fixing member 72, as the fixing member 62, has a fixation foot portion 72*a*. Through the fixation foot portion 72*a*, the fixing member 72 has a shape enabling the film member 73, on which the cleaning member 71 is adhesively fixed, to be adhesively supported. Moreover, the fixation foot portion 72*a* is placed at an upstream side of a contact position between the charging roller 22 and the cleaning member 71 with respect to the rotation direction of the charging roller 22.

The film member 73 is made out of, for example, polyester film, and is sandwiched between the cleaning member 71 and the fixing member 72. The sandwiched film member 73 has approximately the same size as the one surface of the cleaning member 71, and extends to a downstream side of the rotation direction of the charging roller 22 from a contact position of the charging roller 22 and the cleaning member 71. Further, the film member 73 has a thickness capable of producing the same restitution force as that produced by a cleaning member, whose thickness is a difference between a thickness of the cleaning member 71, and a thickness of the cleaning member 51 in the preferred embodiment 1 or the cleaning member 61 in the preferred embodiment 2.

For example, in the case that the diameter of the charging roller 22 is 12 mm, when the film member 73 with thickness of 0.1 mm is provided, with respect to such cleaning member 51 with thickness of 3 mm in the preferred embodiment 1 or such cleaning member 61 with thickness of 3 mm in the preferred embodiment 2, the cleaning member 71 can be thinned to 2 mm. That is, the film member 73, in the case that its thickness is 0.1 mm, produces the same restitution force as a cleaning member whose thickness is 1 mm. The film member 73, for example, is adhesively fixed to the cleaning member 71 and the fixing member 72 via two-sided tape 53*a*, 53*b* on both of its outer surfaces. Moreover, the fixation method of the cleaning member 71 with respect to the cleaning member 71 and the fixing member 72 is not limited by the two-sided tape. Further, the cleaning section 70, as the film member 73, may be made up of any other elastic material such as board-shaped spring formed of metal having a bend elasticity coefficient greater than the cleaning member 71.

In the cleaning section 70, through forming a space between the fixation foot portion 72*a* and the covering member 42, and forming the fixing member 72 so as to not contact the cleaning member 71 in the area of the second surface opposite to the contact part between the charging roller 22 and the cleaning member 71, with respect to the radius direction of the charging roller 22, even if the installation position of the cleaning member 71 is uneven and the cleaning member 71 is installed in a direction to approach the charging roller 22, because the force applied onto the board shape plane portion 71*b* of the cleaning member 71 releases toward the radius direction of the charging roller 22, the amount by which the board shape plane portion 71*b* is compressed does not become large. That is, in the cleaning member 71, through its own elasticity and the elasticity of the film member 73, the board shape plane portion 71*b* contacts the charging roller 22.

As stated above, in the image forming apparatus of the preferred embodiment 3 of the present invention, as compared with the image forming apparatus in the preferred embodiment 2, even if using the cleaning member 71 whose thickness is thin, it is possible to obtain the same effects as the image forming apparatus in the preferred embodiment 2. As a result, the image forming apparatus can be miniaturized.

Further, in the image forming apparatus, through changing the thickness and the material of the film member 73, without transforming the cleaning member 71, it is possible to change the pressing and contacting force with respect to the charging roller 22.

Moreover, the present invention is not limited in the above-stated preferred embodiments. For example, in the above-stated preferred embodiments, only the case of removing developer, such as toner sticking on the surface of the charging roller, is explained. However, the present invention also can be applied to other cases to perform a cleaning of rotation body, such as image carrying body being photo-sensitive drum or the like, or transferring roller or the like. Further, the present invention also can be applied to the case of shaving toner from developing roller. Furthermore, the present invention can be applied to the case of removing toner from transferring belt or photo-sensitive belt. That is, not only can the present invention be applied to rotation body of roller shape, but also the present invention can be applied to rotation body of belt shape.

Further, in the preferred embodiments, only the toner, serving as a sticking substance, is removed. However, other sticking substances, such as refuse, dust, useless matter or the like, also can be removed. That is, not only can the present invention be applied to the case of removing a sticking substance, such as toner, but also the present invention can be applied to the case of removing the above-mentioned other sticking substance, such as refuse, dust, useless matter or the like. As a result, the present invention can be widely applied for removing a sticking substance sticking on the surface of the rotation body.

Further, the present invention can be easily applied to, for example, a printer that has a conveying roller to convey record medium, a facsimile apparatus, a copying apparatus, a multi-function apparatus having printing function, facsimile function and copying function, or the like.

The present invention is not limited to the foregoing embodiments but many incorporate modifications and variations within the spirit and scope of the appended claims.

What is claimed is:

1. A sticking substance removing apparatus for removing a sticking substance sticking on a surface of an appointed rotating body, said apparatus comprising:

a contacting member having an elongated shape and a first surface and a second surface, wherein said contacting member is fixed at a side of a first end and is not fixed at a side of a second end and contacts said rotating body through said first surface at said side of said second end; and a supporting section which supports said contacting member at least at an upstream side of a contact position between said rotating body and said contacting member with respect to a rotation direction of said rotating body, wherein said supporting section is formed so as to not contact said contacting member at least in an area of said second surface which is opposite to a contact part of said rotating body and said contacting member, wherein said supporting section includes two supporting areas to respectively support said contacting member at said upstream side and at a downstream side of said contact position between said rotating body and said contacting member with respect to said rotation direction of said rotating body, and wherein when setting a straight line distance corresponding to said contact part of said contacting member and said rotating body as a distance "a", setting a contact point approximately in a center of said distance "a" as "P", and setting an interval between said two supporting areas along a tangent line of said rotating body passing through said contact point "P" as a distance "A", said supporting section is formed so as to meet a relation of "A">"a".

2. The sticking substance removing apparatus according to claim 1, wherein a predetermined space of concave shape is formed by said two supporting areas in a portion of the supporting section.

3. The sticking substance removing apparatus according to claim 1, wherein said contacting member, when said first surface is in contact with said rotating body, is formed so as to fall downwardly.

4. The sticking substance removing apparatus according to claim 3, further comprising:

a reinforcing member sandwiched between said second surface of said contacting member and said supporting section, wherein said reinforcing member is used to reinforce said contacting member.

5. The sticking substance removing apparatus according to claim 4, wherein said reinforcing member has a greater bend elasticity coefficient than said contacting member.

6. The sticking substance removing apparatus according to claim 1, wherein said rotating body is belt shaped.

7. The sticking substance removing apparatus according to claim 1, wherein said rotating body is a charging roller to charge an image carrying body; and said contacting member removes said sticking substance sticking on said surface of said charging roller.

8. The sticking substance removing apparatus according to claim 1, wherein at least a portion of the supporting section has a concave portion extending inwardly into the supporting section from an exterior surface thereof.

9. A sticking substance removing apparatus for removing a sticking substance sticking on a surface of an appointed rotating body, said apparatus comprising:

a contacting member having an elongated shape and a first surface and a second surface, wherein said contacting member is fixed at a side of a first end and is not fixed at a side of a second end and contacts said rotating body through said first surface at said side of said second end; and a supporting section which supports said contacting member at least at an upstream side of a contact position between said rotating body and said contacting member with respect to a rotation direction of said rotating body, wherein said supporting section is formed so as to not contact said contacting member at least in an area of said second surface which is opposite to a contact part of said rotating body and said contacting member, wherein said supporting section supports said contacting member respectively at said upstream side and at a downstream side of said contact position between said rotating body and said contacting member with respect to a rotation direction of said rotating body, wherein said supporting section includes two supporting areas to respectively support said contacting member at said upstream side and at said downstream side of said contact position between said rotating body and said contacting member with respect to said rotation direction of said rotating body, and wherein a predetermined space of concave shape is formed by said two supporting areas in a portion of the supporting section, and wherein when setting a straight line distance corresponding to said contact part of said contacting member and said rotating body as a distance "a", setting a contact point approximately in a center of said distance "a" as "P", and setting an interval between said two supporting areas along a tangent line of said rotating body passing through said contact point "P" as a distance "A", said supporting section is formed so as to meet a relation of "A">"a", and wherein when setting a maximum projection quantity of said contacting member caused by a pressure toward said radius direction of said rotating body at said contact point "P" as a distance "b", and setting a distance of said space of said supporting section in said radius direction of said rotating body at said contact point "P" as a distance "B", said supporting section is formed so as to meet a relation of "B">"b".

10. An image forming apparatus for forming an image onto an appointed record medium, said apparatus comprising:

an image forming section to develop an electrostatic latent image formed on an image carrying body through a sticking substance, said image forming section performs an image formation with respect to said record medium; and a sticking substance removing section to remove a sticking substance sticking on surface of an appointed rotating body, wherein said sticking substance removing section includes:

a contacting member having an elongated shape and a first surface and a second surface, wherein said contacting member is fixed at a side of a first end and is not fixed at a side of a second end and contacts said rotating body through said first surface at said side of said second end; and a supporting section which supports said contacting member at least at an upstream side of a contact position between said rotating body and said contacting member with respect to a rotation direction of said rotating body, said supporting section is formed so as to not contact said contacting member at least in an area of said second surface which is opposite to a contact part of said rotating body and said contacting member, wherein said supporting section includes two supporting areas to respectively support said contacting member at said upstream side and at a downstream side of said contact position between said rotating body and said contacting member with respect to said rotation direction of said rotating body, and wherein when setting a straight line distance corresponding to said contact part of said contacting member and said rotating body as a distance "a", setting a contact point approximately in a center of said distance "a" as "P", and setting an interval between said two supporting areas along a tangent line of said rotating body passing through said contact point "P" as a distance "A", said supporting section is formed so as to meet a relation of "A">"a".

* * * * *